United States Patent [19]

Beshore

[11] Patent Number: 4,775,388

[45] Date of Patent: Oct. 4, 1988

[54] FUEL COMPOSITION COMPRISED OF HEAT-TREATED DEWATERED SEWAGE SLUDGE AND A BIOCIDE-CONTAINING FUEL OIL

[75] Inventor: David G. Beshore, St. Petersburg, Fla.

[73] Assignee: Electric Fuels Corporation, St. Petersburg, Fla.

[21] Appl. No.: 3,058

[22] Filed: Jan. 13, 1987

[51] Int. Cl.[4] ..... C10L 1/32

[52] U.S. Cl. ..... 44/51; 44/605; 71/67; 110/346

[58] Field of Search ..... 44/51, 1 D; 71/67; 110/7, 342, 346; 210/274

[56] References Cited

U.S. PATENT DOCUMENTS

| | | | |
|---|---|---|---|
| 2,680,058 | 6/1954 | Harris et al. | 210/764 |
| 2,975,042 | 3/1961 | Summers | 44/50 |
| 3,296,122 | 1/1967 | Karassik et al. | 210/764 |
| 3,559,596 | 2/1971 | Ishii et al. | 110/346 |
| 3,642,135 | 2/1972 | Borden | 210/764 |
| 3,655,395 | 4/1972 | Karnemaat | 71/28 |
| 3,883,303 | 5/1975 | Roberts | 210/764 |
| 3,915,970 | 10/1975 | Limage et al. | 44/51 |
| 4,026,223 | 5/1977 | Robbins | 110/238 |
| 4,081,366 | 3/1978 | O'Donnell | 71/13 |
| 4,102,277 | 7/1978 | Wall | 110/342 |
| 4,108,771 | 8/1978 | Weiss | 210/723 |
| 4,145,188 | 3/1979 | Espenscheid et al. | 585/240 |
| 4,159,684 | 7/1979 | Kirkup | 44/1 D |
| 4,168,670 | 9/1979 | Wall et al. | 110/346 |
| 4,405,332 | 9/1983 | Rodriguez et al. | 44/51 |
| 4,462,820 | 7/1984 | Grade et al. | 210/764 |
| 4,479,820 | 10/1984 | Merk et al. | 210/764 |
| 4,541,986 | 9/1985 | Schwab et al. | 210/764 |
| 4,560,391 | 12/1985 | Ashworth | 44/51 |

FOREIGN PATENT DOCUMENTS

| | | |
|---|---|---|
| 55-94996 | 7/1980 | Japan . |
| 0949000 | 5/1964 | United Kingdom . |
| 1198958 | 7/1970 | United Kingdom . |

*Primary Examiner*—William R. Dixon, Jr.
*Assistant Examiner*—Margaret B. Medley
*Attorney, Agent, or Firm*—James W. Hellwege

[57] ABSTRACT

An improved fuel composition is provided comprised of a colloidal dispersion of a heat-treated dewatered sewage sludge and a biocide-containing hydrocarbon fuel oil. A method is also provided for the incineration of sewage sludge comprised of providing a fuel composition comprised of a colloidal dispersion of a heat-treated dewatered sewage sludge in a biocide-containing fuel oil, and incinerating the fuel composition.

36 Claims, 6 Drawing Sheets

| STREAM NUMBER | 1 | 7 | 10 | 12 | 14 | 17 | 21 | 24 | 26 | 28 | 30 | 32 | 33 | 40 | 5 |
|---|---|---|---|---|---|---|---|---|---|---|---|---|---|---|---|
| MASS FLOWRATE (LB/HR) | 1000 | 100 | 100 | 185 | 0.009 | 185 | 185 | 285 | 285 | 285 | 285 | 285 | 285 | 285 | 900 |
| PRESSURE (PSIG) | 0 | 0 | 0 | 0 | 0 | 10 | 0 | 0 | 80 | 75 | 70 | 70 | 65 | 0 | 0 |
| TEMP. (DEGREES FAHRENHEIT) | 80 | 80 | 80 | 100 | 80 | 178 | 178 | 130 | 130 | 232 | 300 | 300 | 198 | 158 | 80 |
| TEMP. (DEGREES CENTIGRADE) | 27 | 27 | 27 | 38 | 27 | 81 | 81 | 54 | 54 | 111 | 148 | 148 | 92 | 70 | 27 |

SLUDGE-OIL BLOCK FLOW DIAGRAM

FUEL RESPIRATION TEST METHOD

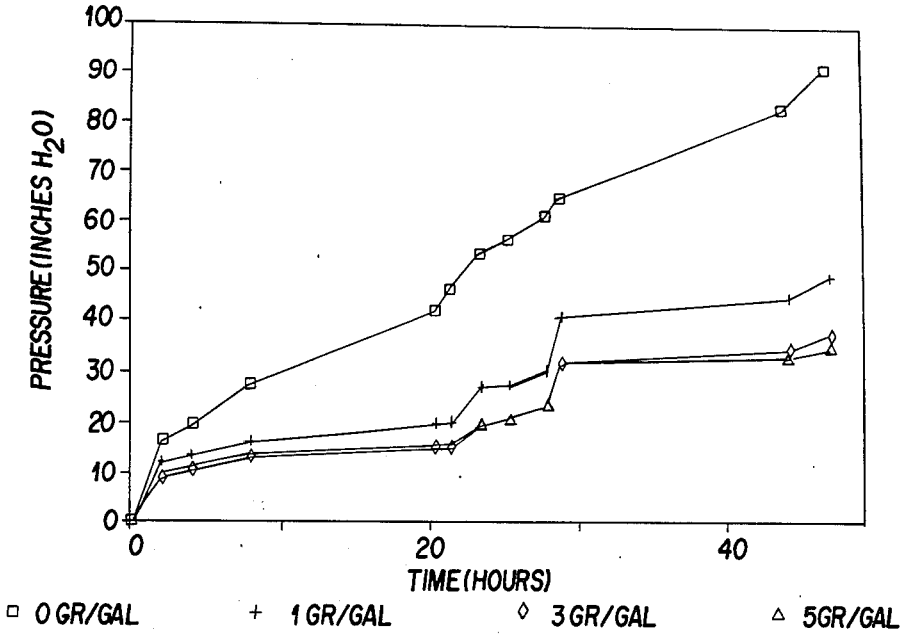
RESPIRATION TESTS AT 100 °F. FIG. 5
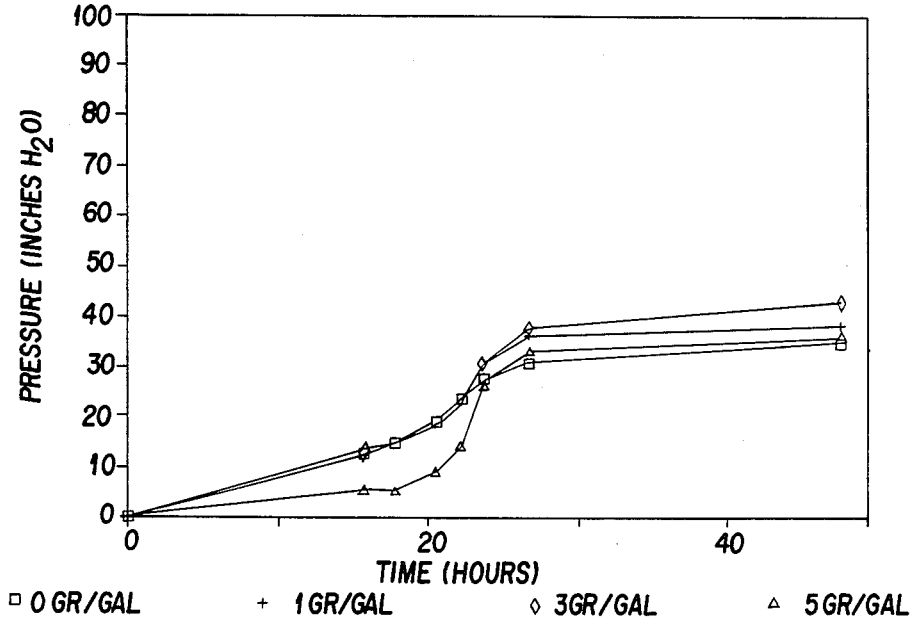
RESPIRATION TESTS AT 100 °F. FIG. 6

RESPIRATION TESTS AT 100 °F.
AFTER 130°F. HEAT TREATMENT FOR 2 DAYS

BASIS: 35 % SLUDGE (30 % SOLIDS) - 65 % OIL

| STREAM NUMBER | 1 | 7 | 10 | 12 | 14 | 17 | 21 | 24 | 26 | 28 | 30 | 32 | 33 | 40 | 5 |
|---|---|---|---|---|---|---|---|---|---|---|---|---|---|---|---|
| MASS FLOW RATE (LB/HR) | 1000 | 100 | 100 | 185 | 0.009 | 185 | 185 | 285 | 285 | 285 | 285 | 285 | 285 | 285 | 900 |
| PRESSURE (PSIG) | 0 | 0 | 0 | 0 | 0 | 10 | 0 | 0 | 80 | 75 | 70 | 70 | 65 | 0 | 0 |
| TEMP. (DEGREES FAHRENHEIT) | 80 | 80 | 80 | 100 | 80 | 178 | 178 | 130 | 130 | 232 | 300 | 300 | 198 | 158 | 80 |
| TEMP. (DEGREES CENTIGRADE) | 27 | 27 | 27 | 38 | 27 | 81 | 81 | 54 | 54 | 111 | 148 | 148 | 92 | 70 | 27 |

SLUDGE-OIL BLOCK FLOW DIAGRAM

FUEL VISCOSITY COMPARISON

FUEL COMPOSITION COMPRISED OF HEAT-TREATED DEWATERED SEWAGE SLUDGE AND A BIOCIDE-CONTAINING FUEL OIL

BACKGROUND OF THE INVENTION

The present invention is directed to a fuel composition comprised of dewatered sewage sludge and a liquid hydrocarbon fuel oil.

In an effort to provide an economic and environmentally acceptable method for the disposal of sewage sludge, various municipalities have begun to investigate various means to accomplish this difficult task. Disposal of sewage sludge is rapidly becoming a world-wide problem. Many large municipalities on ocean coastlines dump sewage sludge produced by them into the oceans with the consequence of ultimately endangering ocean aquatic life. Inland municipalities frequently employ the sludge as a source of plant nutrients.

However, the supply of sewage sludge is rapidly exceeding demand. As a result, the sewage sludge is frequently disposed of by means of landfill. Others employ expensive and involved incineration methods to dispose of their sludge whereby the sludge is first dried to form a combustible solid. Because of the rapid increase in the world population over the last 100 years and the shift from an agrarian-based to urban-based culture, the use and/or disposal of increasing quantities of sewage sludge is rapidly becoming a problem of alarming proportion. Furthermore, toxic and hazardous wastes comprise an important component of sludge, adding to the complexity and safety of current sludge disposal techniques since such components are highly leachable. Therefore, it would be extremely advantageous to provide an economic and environmentally acceptable alternative means of disposal of such sewage sludge, thereby avoiding the problems associated with landfills and ocean dumping.

Two incineration methods are commonly employed for the incineration of sewage sludge; i.e., fluidized beds and multiple hearth furnaces. Both methods were developed to provide on-site sewage sludge capability at sewage treatment plants. Each method employs efficient heat transfer mechanisms to minimize fuel consumption which limits the exposure of the sludge to high temperatures within the incinerator. Afterburners are accordingly frequently employed to minimize the discharge of offensive odors from such incinerators. Maximum temperatures on the order of about 815° C. are attained in fluid bed incinerators. Multiple hearth furnaces expose freshly fed sludge to cool combustion gases as low as 65° to 160° C. prior to entering the final combustion zone at 750° to 950° C.

Various methods have been discussed in the patent literature for the disposal of sewage sludge by incineration. For example, U.S. Pat. No. 4,560,391 (issued to Ashworth) discloses a fuel composition comprised of non-dewatered sewage sludge and an organic fuel comprised of a fuel oil. U.S. Pat. No. 4,405,332 (issued to Rodriguez et al) discloses a fuel composition comprised of non-dewatered sewage sludge and a particulate solid fuel such as coal. U.S. Pat. No. 4,026,223 (issued to Robbins) discloses a sludge incinerator for use in the flash evaporation of water contained in high moisture sludges. The patent states at column 2, lines 31–33 that "waste oil or other flammable hydrocarbons may be introduced along with the sludge to aid in the ignition of the sludge." U.S. Pat. No. 4,145,188 (issued to Espenscheid et al) discloses a process for the liquefaction of municipal refuse and other solid organic wastes in a highly aromatic refinery petroleum solvent to provide a liquid fuel. U.S. Pat. Nos. 4,102,277 and 4,168,670 (each issued to Wall et al) disclose the incineration of lime-conditioned dewatered sewage sludge with a high sulfur fuel such as a fuel oil. British Pat. No. 1,198,958 discloses a solid fuel composition comprised of solid sewage waste, coal tip waste and waste oil. British Pat. No. 949,000 discloses the incineration of dewatered sewage sludge solids in admixture with a fuel oil.

U.S. Pat. No. 3,559,596 (issued to Ishii et al) is directed to a method and apparatus for the incineration of sewage sludge wherein a sludge is subjected to pressure and heated concurrently and then jetted into a combustion chamber. Water contained in the sludge is evaporated instantaneously with the jetting, with the remaining solids being incinerated. The patent discloses at column 2, lines 62–65 that the sludge-feeding duct is connected to a heavy oil-feeding duct. Example 1 also discloses the admixture of heavy oil with a sludge which is comprised of 80 percent by weight of water. The patent appears to be directed to the use of a partially-dewatered sludge as noted in the Examples (water content of 75–80 percent) and column 1, lines 15–20 wherein the partial dewatering of activated and digested sludge is discussed.

Japanese Patent Publication No. 55-94996 discloses a slurry fuel which includes particulate coal, oil, sewage sludge and a viscosity-lowering additive. The patent states that the sludge may contain from 30 to 90 percent water and generally envisions the use of partially dewatered sludge containing less than 50 percent by weight of water.

While the combining of sewage sludge with a fuel oil enables various advantages to be achieved, it has been found that the use of such a composition is somewhat less than practical under all circumstances. It has been discovered that the growth of microorganisms inherently present in the sewage sludge is substantially enhanced by the additional presence of the fuel oil. That is, the rate of growth of the microorganisms within a sewage sludge-fuel oil composition greatly exceeds the rate of growth of the microorganisms in either the sewage sludge or fuel oil alone.

While enhanced growth of such microorganisms would not generally be cause for concern when the fuel composition is combusted shortly after formation, fuel compositions must possess substantial long-term stability due to the fact that they are frequently stored prior to being combusted. It has been found that even the short-term storage of a sewage sludge-fuel oil composition under ambient conditions may result in the production of obnoxious by-products of microorganism growth which render contact with or exposure to the fuel composition highly undesirable if not impossible. Such undesirable states can be reached in as few as 1 to 3 days. Use of the fuel composition as a fuel once such an obnoxious state has been achieved is virtually precluded.

The prior art has recognized the inherent problems which exist with regard to microbial growth in both sewage sludge and hydrocarbon fuels and various methods of addressing such growth have been proposed.

For instance, U.S. Pat. Nos. 2,680,058 (issued to Harris) and 4,462,820 (issued to Grade et al) each teach the addition of a biocide to fuel oils to reduce microbial growth.

U.S. Pat. No. 4,108,771 (issued to Weiss); U.S. Pat. No. 4,541,986 (issued to Schwab et al); U.S. Pat. No. 3,883,303 (issued to Roberts); U.S. Pat. No. 4,081,366 (issued to O'Connell); U.S. Pat. No. 3,655,395 (issued to karnemaat); U.S. Pat. No. 4,462,820 (issued to Grade et al) and U.S. Pat. No. 4,479,820 (issued to Merk et al) teach the addition of biocides to aqueous waste compositions.

U.S. Pat. Nos. 3,642,135 (issued to Borden) and 3,296,122 (issued to karassik et al) each teach the heat treatment of sewage sludge during the disposal of same.

However, the prior art has not addressed the problem of microbial growth in fuel compositions comprised of sewage sludge and a hydrocarbon fuel oil, a composition which has been found to particularly foster microbial growth. Conventional sewage sludge incineration techniques also have been found to be inadequate to enable substantially complete combustion of the sludge solids to occur in such prior art compositions.

OBJECTS AND SUMMARY OF THE INVENTION

It is therefore an object of the present invention to provide a novel sewage sludge-based combustible fuel.

It is also an object of the present invention to provide a combustible fuel which can be readily adapted, at low cost, for use with existing fuel oil-fired boilers.

It is still another object of the present invention to provide an improved method for the disposal of sewage sludge.

It is still another object of the present invention to provide a sewage sludge-fuel oil fuel composition which exhibits highly acceptable storage stability.

It is still further an object of the present invention to provide a method for the incineration of sewage sludge which enables substantially complete combustion of the sludge solids to occur.

It is yet further an object of the present invention to eliminate and/or minimize gas production as a result of microorganism activity upon the formation of a sewage sludge-fuel oil composition.

It is yet further an object of the present invention to reduce offensive odors that may be associated with sludge storage both in the form of a sewage sludge-fuel oil composition and in the form of dewatered sludge.

It is still further an object of the present invention to overcome the disadvantages of the prior art as discussed above.

In accordance with one aspect of the present invention, there is thus provided an improved fuel composition comprised of a colloidal dispersion of a sewage sludge in a fuel oil, said composition comprising (1) from about 20 to 70 percent by weight of a heat-treated dewatered sewage sludge comprising from about 50 to 85 percent by weight of water with the remainder comprising solids, said sewage sludge having been heat-treated under conditions effective to substantially reduce the microorganism activity within said composition while maintaining the water content of said sewage sludge within said range and (2) from about 30 to 80 percent by weight of a fuel oil containing an at least oil soluble or dispersible biocide in an amount effective to inhibit the growth of microorganisms within said composition.

In accordance with another aspect of the present invention, there is provided a method for the incineration of a sewage sludge comprising the steps of providing a fuel composition comprised of a colloidal dispersion of a sewage sludge in a fuel oil, said composition comprising (1) from about 20 to 70 percent by weight of a heat-treated dewatered sewage sludge comprising from about 50 to 85 percent by weight of water with the remainder comprising solids, said sewage sludge having been heat-treated under conditions effective to substantially reduce the microorganism activity within said composition while maintaining the water content of said sewage sludge within said range and (2) from about 30 to 80 percent by weight of a fuel oil containing an at least oil soluble or dispersible biocide in an amount effective to inhibit the growth of microorganisms within said composition, and incinerating said composition.

In accordance with yet another aspect of the present invention, there is provided a method for the production of an improved fuel composition comprising the steps of providing a dewatered sewage sludge having a water content in the range of from about 50 to 85 percent by weight, providing a fuel oil containing an at least oil soluble or dispersible biocide in an amount effective to inhibit the growth of microorganisms within said composition, combining said sewage sludge with said fuel oil in a manner sufficient to result in the formation of a colloidal dispersion of said sewage sludge in the fuel oil and heat-treating said colloidal dispersion under conditions effective to substantially reduce the microorganism activity within said composition while maintaining the water content of said sewage sludge within said range.

In accordance with still yet another aspect of the present invention, there is provided a method for the production of an improved fuel composition comprising the steps of providing a dewatered sewage sludge having a water content in the range of from about 50 to 85 percent by weight, heat-treating said dewatered sewage sludge under conditions effective to substantially reduce microorganism activity within said sewage sludge while maintaining the water content of said sewage sludge within said range, providing a fuel oil containing an at least oil soluble or dispersible biocide in an amount effective to inhibit the growth of microorganisms within said composition, and combining said heat-treated, dewatered sewage sludge with said fuel oil in a manner sufficient to result in the formation of a colloidal dispersion of said sewage sludge in the fuel oil.

BRIEF DESCRIPTION OF THE DRAWINGS

FIGS. 5–7 graphically depict the results of microorganism activity tests conducted in connection with sewage sludge-fuel oil compositions.

DETAILED DESCRIPTION OF THE INVENTION

Figure 1:
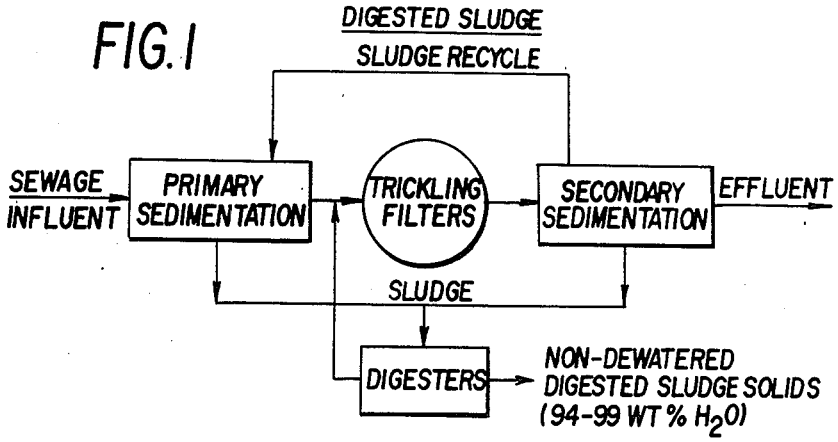
FIGS. 1–3 depict schematically various conventional methods for the treatment of raw sewage, the thus-produced sludge solids of which may be employed to produce the dewatered sewage sludge portion of the fuel composition of the present invention.

It has been surprisingly and unexpectedly found that a composition comprised of dewatered sewage sludge and a liquid hydrocarbon fuel oil prepared in accordance with the teachings of the present invention is well suited for use as a combustible fuel.

The combustible fuel composition of the present invention enables many advantages to be realized. For instance, sewage sludge is generally readily available and the use thereof in such a composition enables disposal problems to be simplified by avoiding the use of landfills and expensive, complex incineration and/or purification processes. In addition, the use of a dewatered sewage sludge reduces transportation costs which may be incurred. Pathogens, viruses, bacteria, polychlorinated biphenyls, etc. which may be present in the sludge will also be combusted and destroyed, with the sludge in the fuel preferably encountering a hot flame zone at a temperature of from about 1300° to 2000° C. and a post-flame hot zone having a temperature of greater than about 1100° C. Additionally, the sludge portion (as the dispersed phase of the composition) is dispersed in the fuel oil (as the continuous phase of the composition) in the form of a colloid of fine particle size, ensuring that substantially complete combustion of the sludge within the burner is accomplished. The size of the colloidal particles is generally less than about 5 to 10 microns, and preferably less than 1 micron in dimension.

A further advantage of the more complete combustion accomplished by means of the present invention is that reduction of excess air is possible during combustion. With the reduction of excess air, lower quantities of nitrogen oxides should be produced compared to conventional oil firing. Although the need for excess combustion air is reduced, the flame temperature is not increased accordingly due to the water content of the sludge. Therefore, a reduction of thermal nitrogen oxide ($NO_x$) results, thermal $NO_x$ production being dependent on the flame temperature and the quantity of oxygen available during combustion.

Further, the presence of a biocide within the fuel oil portion of the combustion not only reduces the ability of microorganisms to use the oil as a growth medium but also counteracts such growth in the sludge solids as a result of the fuel oil coating and surrounding the sludge solids which are finely dispersed in the fuel oil. Heat treatment of the sewage sludge reduces the initial number of microorganisms whose growth must be minimized during storage and use of the fuel composition. It is the cooperative effect of the heat treatment step and the biocide which forms the basis of the present invention as discussed in greater detail below.

The hydrocarbon liquid fuel employed in the present invention may be comprised of any suitable liquid hydrocarbon fuel oil. The liquid hydrocarbon fuel which is employed can comprise fuel oils of various grades (e.g., Nos. 1, 2, 3, 4, 5 or 6 fuel oils or mixtures thereof), resids, crude oils, coke oven tars, shale oil, bitumen or other suitable liquid hydrocarbon fuels. The preferred fuel oil component comprises Nos. 4, 5 or 6 fuel oil. The above listing is not intended to be all inclusive and one skilled in the art can readily determine which types of fuel oils can be employed as the fuel oil component of the present invention.

The fuel oil typically comprises from about 30 to 80 percent by weight, and preferably comprises from about 50 to 70 percent by weight of the fuel composition.

The sewage sludge component of the fuel admixture of the present invention (including both water and solids portions) typically comprises from about 20 to 70 percent by weight and preferably comprises from about 30 to 50 percent by weight of the fuel composition. A typical composition comprises about 45 percent by weight of sewage sludge and about 55 percent by weight of fuel oil. Such sewage sludge comprises dewatered sewage sludge containing from about 50 to 85 percent by weight of water. The remainder of the sludge comprises combustible (volatile matter) and noncombustible (ash) solids in total amounts ranging from about 15 to about 50 percent by weight.

Sewage sludge is by definition the mixture of sewage (i.e., contaminated water) and settled solids. As a result of the type of treatment received, it may be designated as raw or fresh, digested, activated, dewatered or dried. Other descriptive terms include elutriated, Imhoff and septic tank sludge.

Figure 2:
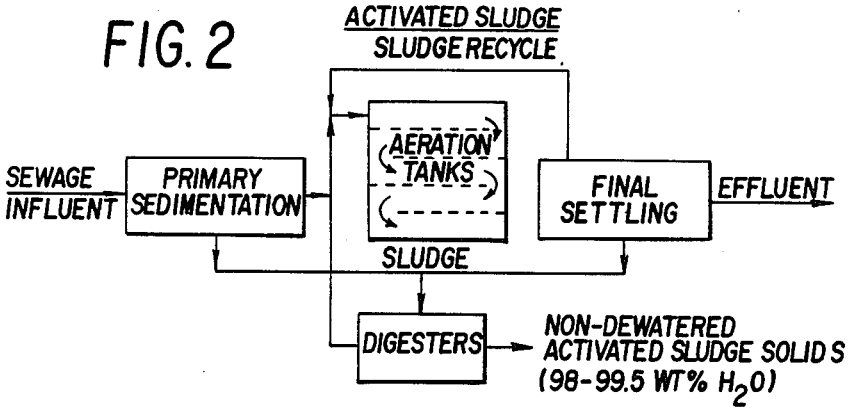
Figure 3:
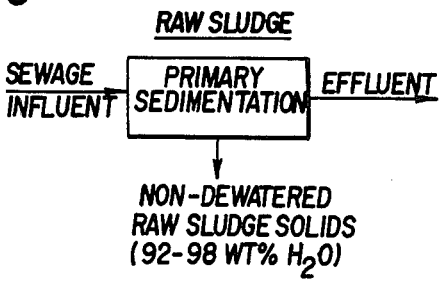

The present invention concerns the utilization of dewatered sludge. Therefore, the sludge to be admixed with the solid fuel would, in most cases, be raw, digested, or activated sludge which have been treated to remove the requisite amount of water. Typical flow diagrams depicting conventional methods for the production of raw (92–98 wt. percent water), digested (94–99 wt. percent water), or activated (98–99.5 wt. percent water) sludge solids are shown in FIGS. 1, 2 and 3, respectively.

Raw sludge solids are produced by plain sedimentation. Digested and activated sludge solids are produced by the secondary treatment of sewage. The digested and activated sludge treatment processes each depend upon aerobic biological organisms to effect decomposition, with the only difference between the two processes being the method of operation. Digested sludge treatment employs trickling filters wherein the organisms attach themselves to the filters and the organic material (sewage) is pumped through the organism for the digestion process. In the activated sludge treatment process, the organisms are migrant and are thoroughly admixed with the organic matter to effect digestion.

The quantity and composition of sludge varies with the character of the sewage from which it is removed. It also is dependent on the type of treatment that it receives. Typical concentrations and analyses of the solids for various non-dewatered sewage sludges are shown in Table 1 below:

TABLE 1

CONCENTRATION AND ANALYSIS OF VARIOUS TYPES OF SLUDGE SOLIDS

| CONSTITUENT, WT % | RAW | DIGESTED | ACTIVATED |
|---|---|---|---|
| Solids, Total | 5–10 | 5–15 | 0.5–2 |
| Solids, Dry Basis: | | | |
| Volatile Matter | 55–80 | 40–60 | 62–75 |
| Ash | 20–45 | 40–60 | 25–38 |
| Insoluble Ash | 15–35 | 30–50 | 22–30 |
| Grease and Fats | 5–35 | 2–17 | 5–12 |
| Protein | 20–28 | 14–30 | 32–41 |
| Ammonium Nitrate | 1–3.5 | 1–4 | 4–7 |
| Phosphoric Acid | 1–1.5 | 0.5–3.7 | 3–4 |
| Potash | | 0–4 | 0.86 |
| Cellulose | 8–13 | 8–13 | 7.8 |
| Silica | | 15–16 | 8.5 |

TABLE 1-continued

| CONCENTRATION AND ANALYSIS OF VARIOUS TYPES OF SLUDGE SOLIDS | | | |
|---|---|---|---|
| CONSTITUENT, WT % | RAW | DIGESTED | ACTIVATED |
| Iron | | 5.4 | 7.1 |

Gross Heating Value 7250 Btu/Lb (dry basis)

Trace metal constituents in sewage sludge solids vary widely depending on the proportion of domestic and industrial quantities that make up the composite. An analysis of trace inorganic constituents for a typical municipal sewage sludge ash is shown in Table 2:

TABLE 2

| SEWAGE SOLIDS ASH TRACE INORGANIC CONSTITUENTS (Concentration in mg/g dried sludge) | | | |
|---|---|---|---|
| Element | Concentration | Element | Concentration |
| Aluminum | 5.1 | Phosphorus | 3.8 |
| Beryllium | 0.0025 | Strontium | 0.13 |
| Iron | 16.0 | Vanadium | 2.1 |
| Magnesium | 10.6 | Gallium | 0.006 |
| Copper | 2.0 | Nickel | 0.52 |
| Cobalt | 0.22 | Manganese | 0.78 |
| Tin | 0.95 | Cadmium | <0.19 |
| Silver | 0.24 | Zinc | 6.9 |
| Lead | 1.0 | Mercury | 0.005 |
| Arsenic | <1.2 | Titanium | 14.8 |
| Barium | 2.2 | Chromium | 2.0 |
| Molybdenum | 0.36 | Boron | 0.10 |
| Zirconium | 1.7 | Sodium | 4.0 |

Depending on the sewage sludge solids ash content and analysis and also the location of the incineration facility (i.e., utility, industrial or municipal boiler) an electrostatic precipitator, bag house, etc., may or may not be required to meet federal and/or state regulations concerning particulate emissions upon incineration of the fuel composition of the present invention.

The non-dewatered sewage sludge recovered from the sewage treatment plant may be dewatered by any suitable means in order to result in the production of a dewatered sludge component suitable for use in the present invention. For instance, the non-dewatered sewage sludge may be dried by exposure to elevated temperatures (e.g., at a temperature in the range of from about 90° to 120° C.) or subjected to a filtering or press operation to physically separate the sludge solids from a major portion of the water contained in the sewage sludge. The method by which such dewatering is accomplished is not critical as long as a dewatered sewage sludge product is produced having the requisite water content. Such methods are well known to those skilled in the art.

By way of background, various types of microorganisms must be dealt with during practice of the present invention. Such microorganisms include but are not limited to bacteria, fungi, algae, protozoa, rotifers, crustaceans and viruses, with bacteria (both aerobic and anerobic) being the most widely occurring microorganism in the sewage sludge.

The oxygen-consuming (or aerobic) bacteria are involved in the following processes within the sludge:

(1) Oxidation

COHNS (organic matter) + $O_2$ + bacteria → $CO_2$ + $NH_3$ + other products + energy (2) Synthesis COHNS (organic matter) + $O_2$ + bacteria + energy → $C_5H_7NO_2$ (new cells)

(3) Endogenous respiration (autooxidation)

$$C_5H_7NO_2 + 5O_2 \rightarrow 5CO_2 + NH_3 + 2H_2O + \text{energy}$$

The above reactions (1)-(3) thus either produce gases via oxidation and respiration processes or consume gases via synthesis processes with such consumed or produced gases including $O_2$, $CO_2$, $NH_3$ and $H_2O$. Oxygen is consumed in each of the noted processes even if other gaseous byproducts are produced as a result of such consumption.

Algae (if present) also produce and consume gases according to the following processes:

(1) Photosynthesis (in the presence of light)

$$CO_2 + 2H_2O \rightarrow CH_2O \text{ (new algae cells)} + O_2 + H_2O$$

(2) Respiration $$CH_2O + O_2 \rightarrow CO_2 + H_2O$$

Overall, the respiration reaction is of minor consequence in comparison to the daylight-occurring photosynthesis reaction. The net reaction is thus in effect the production of oxygen via reaction (1) during the daylight hours. However, carbon dioxide is concurrently produced at night in reaction (2).

In general, all microorganisms can be classified according to their energy source and carbon requirements as follows:

TABLE 3

| MICROORGANISM CLASSIFICATION BY ENERGY SOURCE AND CARBON SOURCE REQUIREMENT | | |
|---|---|---|
| Classification | Energy Source | Carbon Source |
| Autotrophic | | |
| Photosynthesis | Light | $CO_2$ |
| Chemosynthetic | Inorganic oxidation-reduction reaction | $CO_2$ |
| Heterotrophic | Organic oxidation-reduction reaction | Organic carbon |

In view of the above information, it is clear that the various types of microorganisms are active under different conditions and environmental conditions and as a result exhibit different requirements for light, heat, air, etc. By practice of the present invention each of the relevant microorganisms can be dealt with in a manner which reduces the impact of the microorganisms upon the stability and/or suitability of a sewage sludge-fuel oil fuel composition.

An important aspect of the present invention is the heat treatment of the sewage sludge component in a manner effective to inactivate or kill the most durable of the microorganisms present in the sludge; i.e., bacteria and bacteria spores.

The sewage sludge component may either be heat-treated prior to admixture with the fuel oil component or subsequent to admixture with same. It is believed preferable from the standpoint of process simplicity and efficiency for the fuel composition to be heat-treated subsequent to admixture with the fuel oil.

The sewage sludge will generally be heat-treated at a temperature in the range of from about 90° to 260° C., and most preferably at a temperature in the range of from about 100° to 150° C. The heat treatment will generally be undertaken for a time period within the range of from about 1 to 120 minutes, and preferably from about 5 to 15 minutes. The sewage sludge need only be subjected to the heat treatment for a period of time and at a temperature effective to substantially reduce the level of microorganism activity to the extent desired.

During the heat treatment step the sewage sludge (or the fuel composition) is initially maintained during heat treatment at a pressure sufficient to maintain the water content of the resulting heat-treated sewage sludge within the range of from about 50 to 85 percent by weight. Preferably, the pressure at which the sewage sludge (or the fuel composition) is initially maintained is sufficient to minimize and/or inhibit loss of water from the sludge during heat treatment such that the water content of the sewage sludge component remains substantially unchanged. Such pressure will generally be in the range of from about 5 to 700 psig and preferably in the range of from about 10 to 70 psig. Loss of water can be minimized by the use of elevated pressures as well as the optional use of a steam-containing atmosphere during the heat treatment step (if the sewage sludge is heat-treated apart from the fuel oil component).

Preferably, the increase in the solids content of the sewage sludge component as a result of the heat treatment step should not exceed about 30 percent, based on the solids content of the sludge prior to the heat treatment. In any event, the increase in solids content, if any, should be minimized so that the water content of the heat-treated sewage sludge remains within the range of from about 50 to 85 percent by weight.

The second important aspect of the present invention is the presence of the biocide component, preferably dispersed at least within the fuel oil portion of the composition prior to admixture with the sewage sludge. The biocide component which is employed is at least oil soluble or dispersible, and preferably both oil and water soluble or dispersible. Advantageously, an oil and water soluble or dispersible biocide which is present in the fuel oil portion will be preferential solubility seek out the water contained within the sewage sludge fraction and effectively kill microorganisms contained within the water-containing cells of the sludge as well as those present in the fuel oil. It is also possible to pretreat the sewage sludge component with a water-soluble or dispersible biocide prior to admixture of the sewage sludge with the fuel oil.

The amount of biocide employed is that amount which is effective to reduce the activity of microorganisms which are present to an extent sufficient to enable the fuel composition to exhibit acceptable stability during storage. Additionally, the amount of biocide which will be necessary will vary in relation to the specific biocide which is employed. The determination of such amounts is well within the ability of one skilled in the art.

Various types of biocides may be employed with success in the practice of the present invention including but not limited to the following: phenols such as pentachlorophenol (DOWCIDE 7), trichlorophenol (DOWCIDE 2) and phenylphenol (DOWCIDE 1); amines such as dipropylamine, monobutylamine, ethylenediamine (METASOL J-26), and trimethylenediamine; and miscellaneous biocide agents such as lime, mixed dioxaborinanes (BIOBOR JF), acrolein (AQUALIN) and formaldehyde (formalin). BIOBOR JF is a mixture of the dioxaborinanes 2,2'-oxybis(4,4,6-trimethyl-1,3,2-dioxaborinane) and 2,2'-(1-methyltrimethylenedioxy)-bis-(4-methyl-1,3,2-dioxaborinane). Of the above, dioxaborinanes and amines are preferred in view of their water and oil solubility/dispersibility.

Whichever type of biocide is employed, it is important for the biocide to be sufficiently oil soluble or dispersible such that a substantially continuous phase of the fuel oil and the biocide can be formed. The use of a biocide which forms a discontinuous phase when admixed with the fuel oil should be accordingly avoided. Most preferably, an oil and water soluble or dispersible biocide is employed which will also exhibit an affinity for the dispersed sewage sludge phase.

Various tests were conducted to demonstrate the effectiveness of the combined effect of the heat-treatment of the sewage sludge component and the presence of the biocide within the fuel oil component of the fuel composition.

Figure 4:
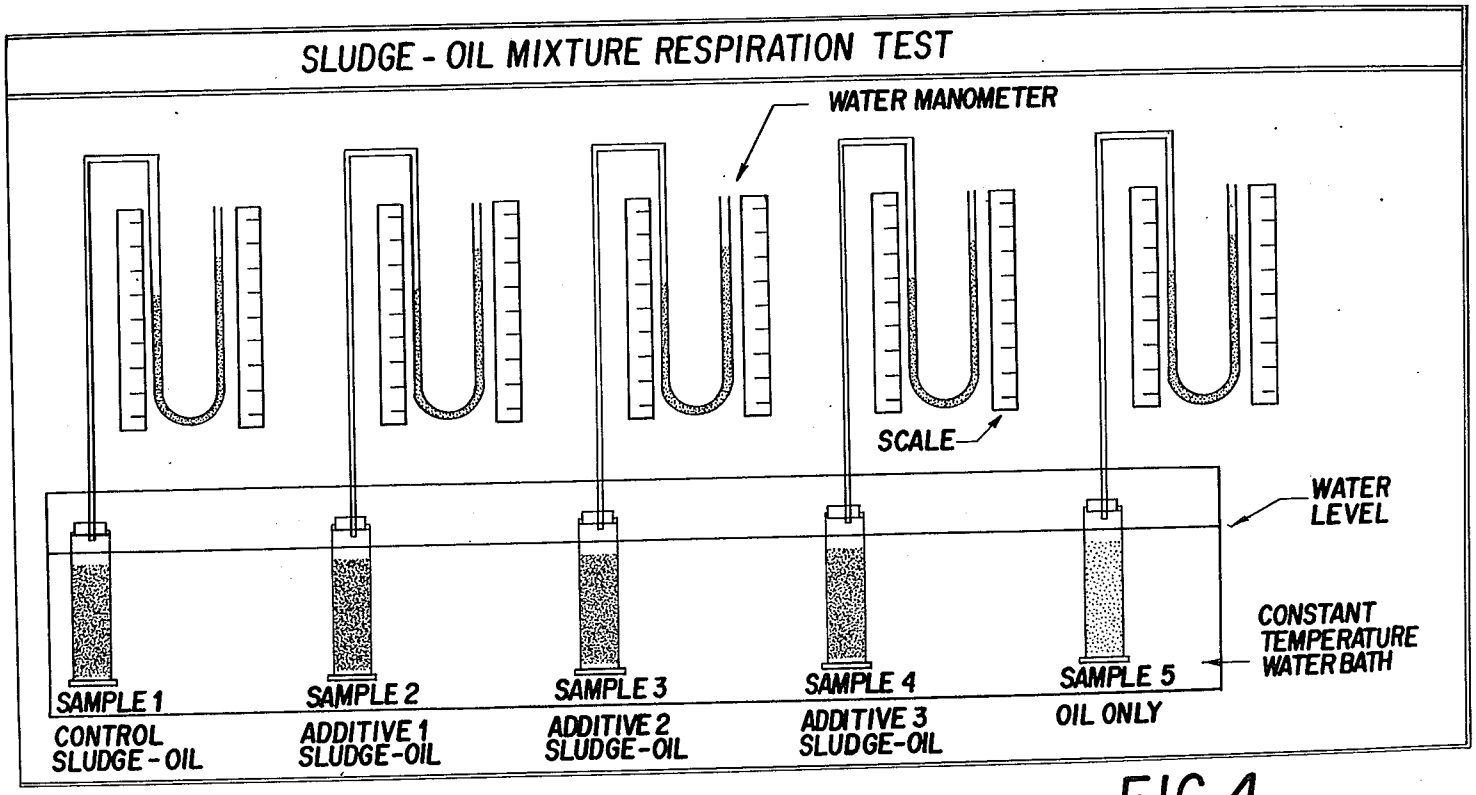
FIG. 4 depicts the test method employed to determine microorganism activity within sewage sludge-fuel oil compositions.

Such tests were conducted by means of the test apparatus depicted at FIG. 4. The Figure depicts an apparatus designed to measure the respiration activity (i.e., gas production and consumption) of microorganisms present in a sewage sludge-fuel oil composition. Such apparatus consists of stoppered plastic tubes or vials from which extend tubing arranged in a manner which permits a reading to be taken indicative of the production or consumption of gas by the sewage sludge-fuel oil composition present in the tube over a period of time. In order to accomplish this result, water was placed within the U-shaped portion of the tubing and a scale placed adjacent to the tubing to permit relative movement of the water to be indicated upon the occurrence of increased or decreased pressure within the tubing (indicative of the production or consumption of gas within the tube by the microorganisms contained within the fuel composition).

Each tube or vial was placed within a constant temperature bath during the experiment maintained at a temperature of either 38° C. (100° F.) or 55° C. (130° F.). Each vial contained a sewage sludge-fuel oil composition having identical proportions of the sewage sludge component and the fuel oil component (i.e., 42 percent by weight of sewage sludge having a water content of 78 percent by weight and 58 percent by weight of a No. 6 fuel oil component).

Sample 1 (the control sample) did not contain a biocide component, while samples 2–4 contained 1, 3 and 5 grams/gallon of a biocide component (Biobor JF), respectively, dispersed in the fuel oil. Sample 5 contained No. 6 fuel oil only.

Figure 7:
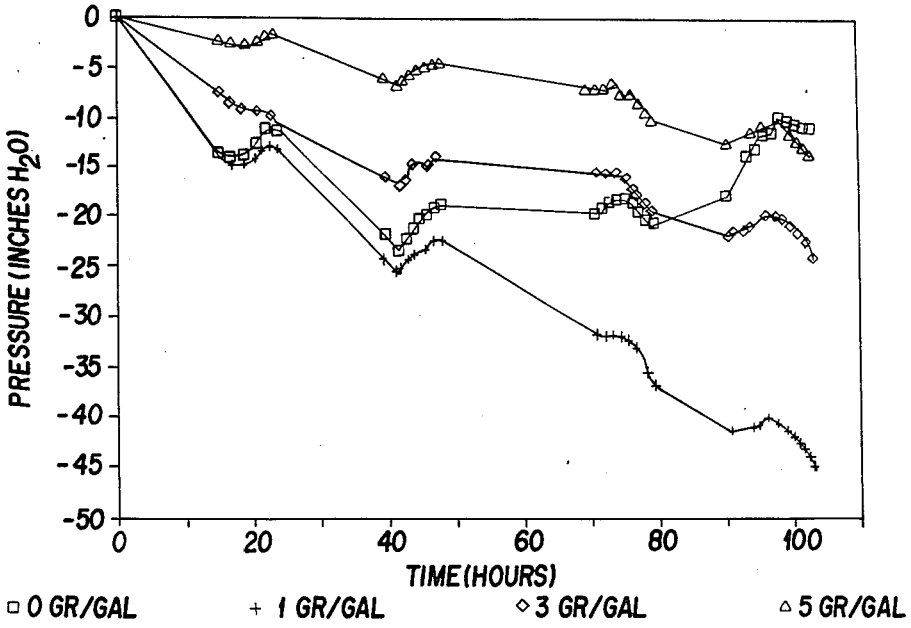

The respiration characteristics of the various samples were then determined upon heat treatment of the samples at one of the noted temperatures with the results depicted in FIGS. 5, 6 and 7.

FIG. 5 depicts the respiration characteristics of the sewage sludge-fuel oil composition during heat treatment of the samples at 38° C. for 48 hours.

FIG. 6 depicts the respiration characteristics of the sewage sludge-fuel oil composition during heat treatment of the samples at 55° C. for 48 hours.

FIG. 7 depicts the respiration characteristics of the sewage sludge-fuel oil composition during heat treatment of the sample of FIG. 6 at 38° C. for an additional 96 hours.

Review of FIGS. 5–7 enables the following conclusions to be drawn in connection with the advantages realized by practice of the present invention.

It is clear from FIG. 5 that the presence of the biocide significantly decreases the activity of the microorganisms present in the sewage sludge-fuel oil composition, with the microorganism activity of samples 2–4 being significantly less than the microorganism activity of the control sample 1. It is also clear that up to a point the level of activity of the microorganisms is proportional to the amount of biocide present in the composition as evidenced by a comparison between the activity of the microorganisms in sample 2 and the level of the microorganisms in samples 3 and 4. It should be noted that the change in slope for the lines depicting the relative microorganism activity in the Figure results from the difference between the activity of the microorganisms during the daylight hours and the activity of the microorganisms during the evening hours, with the increased slope of the lines being indicative of measurements taken during the daylight hours.

FIG. 6 indicates the advantage of the use of higher heat treatment temperatures. Upon use of a heat treatment temperature of 55° C., the effect of the biocide becomes less pronounced in relation to the amount of biocide which is present in each sample.

FIG. 7 indicates that the cooperative effect of the heat treatment and the biocide is necessary in order to enable the desired stability of the fuel composition of the present invention to be achieved. Analysis of this Figure indicates that the biocide appears to focus upon decreasing the activity of those microorganisms which are gas consumers while the heat treatment step appears to focus upon decreasing the activity of those microorganisms which are gas producers.

More specifically, the initial 40 hour period depicted in FIG. 7 indicates that the degree of gas consumption of the microorganisms contained in each sample is inversely proportional to the amount of biocide present in each sample. Such tests were conducted with the samples being sealed from contact with ambient air and any decrease and/or increase in pressure observed for each sample being noted.

The control sample (0 grams/gal) and sample 2 (1 gram/gal) contained the least amount of biocide and as a result consumed the greatest amounts of gas as indicated by the substantial downward trend of the respective curves for samples 1 and 2 and the corresponding drop in pressure as a result of such consumption. Sample 3 (3 grams/gal) consumed a lesser amount of gas, resulting in a smaller drop in pressure during the test. Sample 4 (5 grams/gal) consumed an even lesser amount of gas, also evidenced by a still smaller drop in pressure during the test. No change in pressure was noted for sample 5 (oil only) during any of the tests above.

Air was introduced into each sample at the 40 hour point in the test, with any corresponding decrease and/or increase in pressure again noted. The introduction of such air had no apparent effect upon the samples containing biocide. However, the control sample 1 exhibited a substantial increase in gas production as evidenced by the increase in pressure observed at that point of the test. Thus, the presence of the biocide appears to preferentially effect the ability of gas-producing microorganisms to function.

All samples were covered at the 60 hour point in the test to determine the effect which natural light may have been exerting upon the test results. The data points of all curves indicate that little or no gas was produced during the daylight hours when such readings were taken. Such information indicates that the gas-producing microorganisms present in the samples were chiefly photosynthetic in nature.

Figure 8:
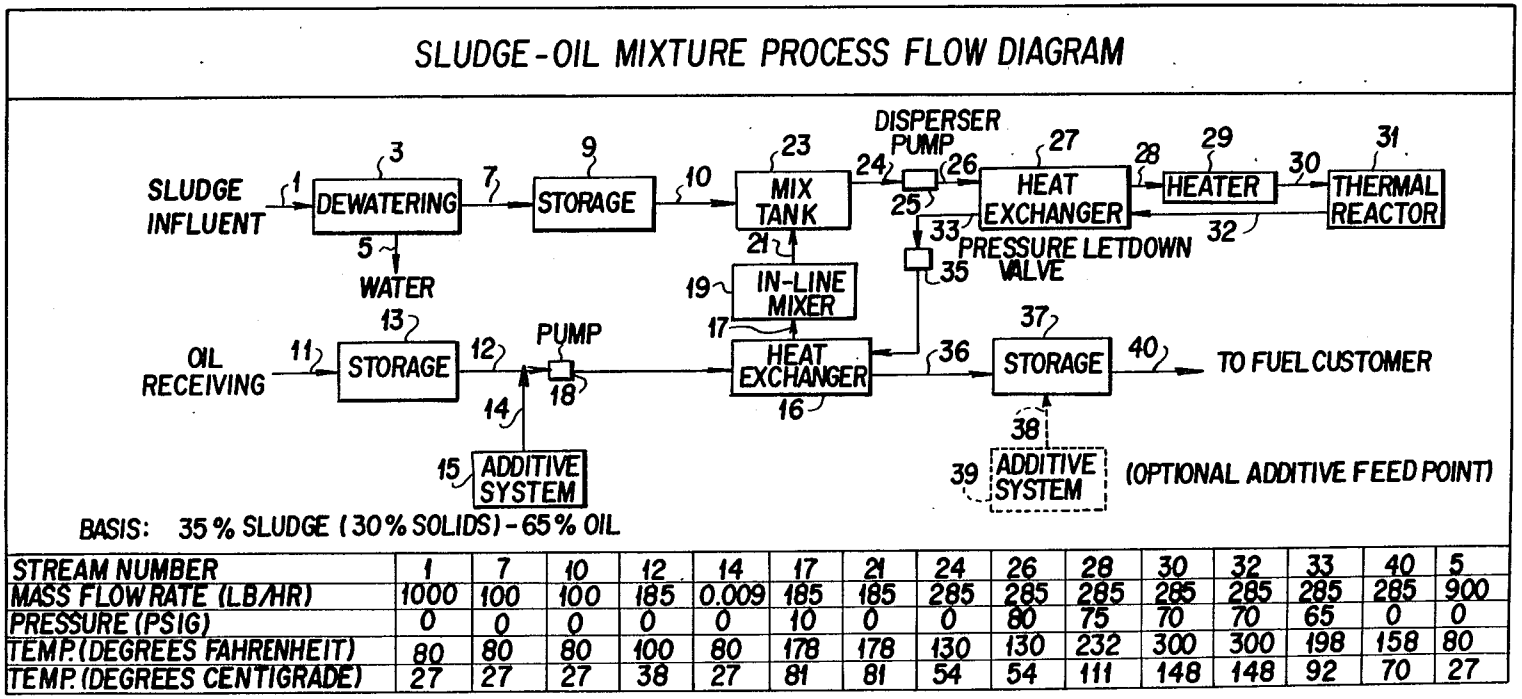
FIG. 8 depicts schematically a process flow diagram describing the method of production of the fuel composition of the present invention.

The fuel composition of the present invention can be prepared as follows and in the manner depicted in FIG. 8.

A non-dewatered sewage sludge component 1 is subjected to a conventional dewatering process 3 from which water 5 is recovered together with a dewatered sludge fraction 7. The dewatered sludge fraction is stored at storage tank 9 for ultimate admixture with the fuel oil component.

The fuel oil component 11 is stored at 13 and in one embodiment subsequently admixed with a suitable biocide additive 15 to yield a biocide-containing fuel oil 17 which is caused to be uniformly dispersed via in-line mixer 19. A heat exchanger 16 is used to recover a portion of residual heat of processed material downstream to increase the oil temperature for ease of processing in subsequent steps. The fuel oil-biocide dispersion 21 is passed to a mixing tank 23 where it is caused to be admixed with the dewatered sewage sludge component drawn from storage tank 9. The resulting admixture is passed to disperser/pump 25, heat exchanger 27, heater 29 and thermal reactor 31 in order to provide a colloidal dispersion of a heat-treated dewatered sewage sludge in a fuel oil. Since such heat treatment is conducted under moderate pressure, the composition 33 is caused to pass pressure letdown valve 35 and passed to heat exchanger 16 and storage tank 37 for eventual shipment to the fuel customer. Optionally, in an alternative embodiment, the biocide additive may be added to the heat-treated composition subsequent to the heat treatment step as indicated at 39.

The colloidal dispersion of the sewage sludge within the fuel oil may be formed by means of a two step mixing process where mix tank 23 is initially employed to attain the correct proportion of sludge to fuel oil while subjecting the mixture to low shear propellor mixing (<500 rpm). The mixture is subsequently passed to a high shear mixing device (at least 1800 rpm) to yield the desired colloidal dispersion.

Various conventional disperser devices can be employed to provide the desired high shear mixing. Such devices include but are not limited to rotor-stator type disperser devices. For example, the Kady Mill disperser of Kinetic Dispersion Company (Scarborough, Maine) and the Dispax disperser of Tekmar Company (Cincinnati, Ohio) are suitable for use in the present invention. Additional dispersers known to those skilled in the art which enable high shear mixing to be achieved and the desired colloidal dispersion to be prepared may also be employed with success.

A composition of a typical dewatered sewage sludge-fuel oil composition prepared in accordance with the present invention is described in Table 4 below:

TABLE 4

| TYPICAL SEWAGE SLUDGE-FUEL OIL COMPOSITION | |
|---|---|
| Sewage Sludge | |
| Solids content (wt %) | 22 |
| Water content (wt %) | 78 |
| Ash content (wt %) | 5 |
| HHV of sludge solids (calc. wt %) | 7500 |
| Fuel Oil | |

TABLE 4-continued

| TYPICAL SEWAGE SLUDGE-FUEL OIL COMPOSITION | |
|---|---|
| No. 6 Oil viscosity (centipoise) | |
| at 40° C. (104° F.) | 684 |
| at 60° C. (140° F.) | 192 |
| at 80° C. (176° F.) | 75 |
| HHV of oil (BTU/lb measured) | 18,048 |
| Sulfur content (wt %) | 2.5 |
| Sewage sludge-fuel oil admixture | |
| Sludge content (wt %) | 42 |
| Oil content (wt %) | 58 |
| Water content of mixture (wt %) | 33 |
| Solids content of mixture (wt %) | 9 |
| HHV of mixture (BTU/lb measured) | 11,164 |
| Sulfur in mixture (wt %) | 1.4 |
| Ash in mixture (wt %) | 2.0 |
| Mixture viscosity (centipoise) | |
| at 40° C. (104° F.) | 1973 |
| at 60° C. (140° F.) | 492 |
| at 80° C. (176° F.) | 228 |

Figure 9:
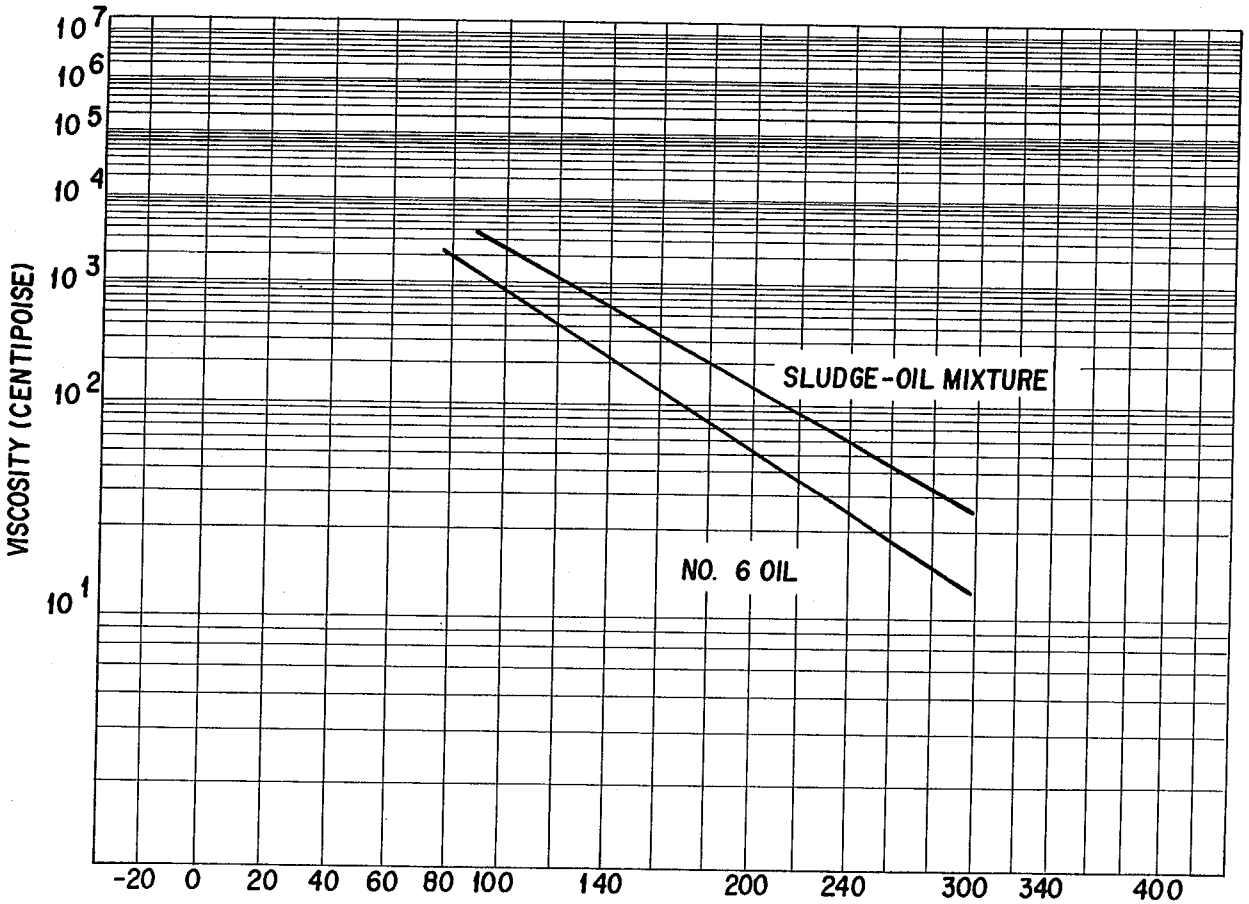
FIG. 9 depicts the relative viscosity characteristics of a fuel oil and a sewage sludge-fuel oil composition.

Advantageously, the viscosity characteristics of the sewage sludge-fuel oil composition of the present invention do not differ significantly from the viscosity characteristics of a No. 6 fuel oil employed in such a composition as depicted in FIG. 9 which summarizes the viscosity data presented in Table 4 above.

The combustible fuel admixture of the present invention can be utilized as a fuel source for a variety of applications such as boilers which are employed in the generation of steam for industrial use or electric power generation. The fuel can be directly substituted for conventional fuel oils without modification of the incineration means. The sewage sludge is incinerated substantially completely during the combustion process which enables the combustion of the fuel admixture to serve as a viable disposal method for sewage sludge without the need for elaborate sludge treatment steps. Most desirably, such combustion is conducted in a manner which achieves flame temperatures in the range of from about 1300° to 2000° C. with the solids being maintained within a post-flame hot gas zone (i.e., in excess of about 1100° C.) for a period of time ranging from 1 to 5 seconds in order to ensure that all sludge solids are combusted and contaminants contained therein are destroyed.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An improved fuel composition comprised of a colloidal dispersion of a sewage sludge in a fuel oil, said composition comprising (1) from about 20 to 70 percent by weight of a heat-treated dewatered sewage sludge comprising from about 50 to 85 percent by weight of water with the remainder comprising solids, said sewage sludge having been heat-treated under conditions effective to substantially reduce the microorganism activity within said composition while maintaining the water content of said sewage sludge within said range, and (2) from about 30 to 80 percent by weight of a fuel oil containing a biocide which is at least oil soluble or dispersible in an amount effective to inhibit the growth of microorganisms within said composition.

2. The fuel composition of claim 1 wherein said fuel oil is selected from the group consisting of Nos. 1, 2, 3, 4, 5, 6 grade fuel oil and mixtures thereof, petroleum residuum, crude oil, shale oil, coke oven tars and bitumen.

3. The fuel composition of claim 1 wherein said biocide is both water and oil soluble or dispersible.

4. The fuel composition of claim 1 wherein said biocide is present in said oil in an amount ranging from about 0.01 to about 0.2 percent by weight based on the weight of the fuel oil.

5. The fuel composition of claim 1 wherein said biocide is selected from the group consisting of dioxaborinanes and amines.

6. The fuel composition of claim 2 wherein said fuel oil is selected from the group consisting of Nos. 4, 5 or 6 grade fuel oil and petroleum residuum.

7. The fuel composition of claim 1 comprising from about 30 to 50 percent by weight of said sewage sludge and from about 50 to 70 percent by weight of said fuel oil.

8. The fuel composition of claim 1 wherein said heat treatment conditions include a temperature in the range of from about 90° to 260° C.

9. The fuel composition of claim 8 wherein said heat treatment conditions include a pressure in the range of from about 5 to 700 psig.

10. A method for the incineration of a sewage sludge comprising the steps of providing a fuel composition comprised of a colloidal dispersion of a sewage sludge in a fuel oil, said composition comprising (1) from about 20 to 70 percent by weight of a heat-treated dewatered sewage sludge comprising from about 50 to 85 percent by weight of water with the remainder comprising solids, said sewage sludge having been heat-treated under conditions effective to substantially reduce the microorganism activity within said composition while maintaining the water content of said sewage sludge within said range and (2) from about 30 to 80 percent by weight of a fuel oil containing a biocide which is at least oil soluble or dispersible in an amount effective to inhibit the growth of microorganisms within said composition, and incinerating said composition.

11. The method of claim 10 wherein said fuel oil is selected from the group consisting of Nos. 1, 2, 3, 4, 5, 6 grade fuel oil and mixtures thereof, petroleum residuum, crude oil, shale oil, coke oven tars and bitumen.

12. The method of claim 10 wherein said biocide is both water and oil soluble or dispersible.

13. The method of claim 10 wherein said biocide is present in said oil in an amount ranging from about 0.01 to about 0.2 percent by weight based on the weight of the fuel oil.

14. The method of claim 10 wherein said biocide is selected from the group consisting of dioxaborinanes and amines.

15. The method of claim 11 wherein said fuel oil is selected from the group consisting of Nos. 4, 5 or 6 grade fuel oil and petroleum residuum.

16. The method of claim 10 wherein said composition comprises from about 30 to 50 percent by weight of said sewage sludge and from about 50 to 70 percent by weight of said fuel oil.

17. The method of claim 10 wherein said heat treatment conditions include a temperature in the range of from about 90° to 260° C.

18. The method of claim 17 wherein said heat treatment conditions include a pressure in the range of from about 5 to 700 psig.

19. A method for the production of an improved fuel composition comprising the steps of providing a dewatered sewage sludge having a water content in the range of from about 50 to 85 percent by weight, providing a fuel oil containing a biocide which is at least oil soluble or dispersible in an amount effective to inhibit the growth of microorganisms within said composition, combining said sewage sludge with said fuel oil in a manner sufficient to result in the formation of a colloidal dispersion of said sewage sludge in the fuel oil, and heat-treating said colloidal dispersion under conditions effective to substantially reduce the microorganism activity within said composition while maintaining the water content of said sewage sludge within said range.

20. The method of claim 19 wherein said fuel oil is selected from the group consisting of Nos. 1, 2, 3, 4, 5, 6 grade fuel oil and mixtures thereof, petroleum residuum, crude oil, shale oil, coke oven tars and bitumen.

21. The method of claim 19 wherein said biocide is both water and oil soluble or dispersible.

22. The method of claim 19 wherein said biocide is present in said oil in an amount ranging from about 0.01 to about 0.2 percent by weight based on the weight of the fuel oil.

23. The method of claim 19 wherein said biocide is selected from the group consisting of dioxaborinanes and amines.

24. The method of claim 20 wherein said fuel oil is selected from the group consisting of Nos. 4, 5 or 6 grade fuel oil and petroleum residuum.

25. The method of claim 19 wherein said composition comprises from about 30 to 50 percent by weight of said sewage sludge and from about 50 to 70 percent by weight of said fuel oil.

26. The method of claim 19 wherein said heat treatment conditions include a temperature in the range of from about 90° to 260° C.

27. The method of claim 26 wherein said heat treatment conditions include a pressure in the range of from about 5 to 700 psig.

28. A method for the production of an improved fuel composition comprising the steps of providing a dewatered sewage sludge having a water content in the range of from about 50 to 85 percent by weight, heat-treating said dewatered sewage sludge under conditions effective to substantially reduce microorganism activity within said sewage sludge while maintaining the water content of said sewage sludge within said range, providing a fuel oil containing a biocide which is at least oil soluble or dispersible in an amount effective to inhibit the growth of microorganisms within said composition, and combining said heat-treated, dewatered sewage sludge with said fuel oil in a manner sufficient to result in the formation of a colloidal dispersion of said sewage sludge in the fuel oil.

29. The method of claim 28 wherein said fuel oil is selected from the group consisting of Nos. 1, 2, 3, 4, 5, 6 grade fuel oil and mixtures thereof, petroleum residuum, crude oil, shale oil, coke oven tars and bitumen.

30. The method of claim 28 wherein said biocide is both water and oil soluble or dispersible.

31. The method of claim 28 wherein said biocide is present in said oil in an amount ranging from about 0.01 to about 0.2 percent by weight based on the weight of the fuel oil.

32. The method of claim 28 wherein said biocide is selected from the group consisting of dioxaborinanes and amines.

33. The method of claim 28 wherein said fuel oil is selected from the group consisting of Nos. 4, 5 or 6 grade fuel oil and petroleum residuum.

34. The method of claim 28 comprising from about 30 to 50 percent by weight of said sewage sludge and from about 50 to 70 percent by weight of said fuel oil.

35. The method of claim 28 wherein said heat treatment conditions include a temperature in the range of from about 90° to 260° C.

36. The method of claim 35 wherein said heat treatment conditions include a pressure in the range of from about 5 to 700 psig.

* * * * *